US011523221B2

(12) United States Patent
Jones et al.

(10) Patent No.: US 11,523,221 B2
(45) Date of Patent: Dec. 6, 2022

(54) DIAPHRAGM FOR USE IN AUDIO TRANSDUCER, AUDIO TRANSDUCER AND METHOD OF MANUFACTURING DIAPHRAGM

(71) Applicant: Tymphany Acoustic Technology Limited, Taipei (TW)

(72) Inventors: Gavin Jones, Taipei (TW); George Albert Bullimore, Taipei (TW); Stuart Martin Hancock, Taipei (TW); Garry David Taylor, Taipei (TW)

(73) Assignee: TYMPHANY ACOUSTIC TECHNOLOGY LIMITED, Taipei (TW)

( * ) Notice: Subject to any disclaimer, the term of this patent is extended or adjusted under 35 U.S.C. 154(b) by 0 days.

(21) Appl. No.: 16/991,767

(22) Filed: Aug. 12, 2020

(65) Prior Publication Data

US 2021/0058708 A1 Feb. 25, 2021

Related U.S. Application Data

(60) Provisional application No. 62/892,872, filed on Aug. 28, 2019, provisional application No. 62/890,907, filed on Aug. 23, 2019.

(51) Int. Cl.

| | |
|---|---|
| ***H04R 7/12*** | (2006.01) |
| ***H04R 1/24*** | (2006.01) |
| ***H04R 7/18*** | (2006.01) |
| ***H04R 31/00*** | (2006.01) |

(52) U.S. Cl.

CPC ..... *H04R 7/127* (2013.01); *H04R 1/24* (2013.01); *H04R 7/18* (2013.01); *H04R 31/003* (2013.01); *H04R 2307/025* (2013.01); *H04R 2400/11* (2013.01)

(58) Field of Classification Search

None

See application file for complete search history.

(56) References Cited

U.S. PATENT DOCUMENTS

| | | | | |
|---|---|---|---|---|
| 5,062,139 | A * | 10/1991 | Christensen | H04R 17/00 381/184 |
| 8,831,270 | B1 * | 9/2014 | Dimitrov | H04R 1/30 381/401 |
| 2005/0253298 | A1 * | 11/2005 | Takayama | B29C 45/561 264/272.16 |
| 2013/0064414 | A1 * | 3/2013 | Flavignard | H04R 1/30 381/412 |
| 2014/0286524 | A1 * | 9/2014 | Robineau | H04R 1/24 381/412 |
| 2017/0048610 | A1 * | 2/2017 | Baird | H04R 1/30 |

* cited by examiner

*Primary Examiner* — Walter F Briney, III

(74) *Attorney, Agent, or Firm* — Muncy, Geissler, Olds & Lowe, P.C.

(57) ABSTRACT

A diaphragm for use in an audio transducer (e.g., a coaxial loudspeaker) includes a higher frequency transducer and a lower frequency transducer. The diaphragm is a component of the lower frequency transducer and is arranged coaxially with the higher frequency transducer. The diaphragm includes a first surface and an opposing second surface. The first surface has a profile shaped to define a horn for output from the higher frequency transducer and the geometry of the first surface is independent of the geometry of the second surface.

14 Claims, 2 Drawing Sheets

DIAPHRAGM FOR USE IN AUDIO TRANSDUCER, AUDIO TRANSDUCER AND METHOD OF MANUFACTURING DIAPHRAGM

CROSS REFERENCE TO RELATED APPLICATIONS

The present application claims priority to U.S. Provisional Application No. 62/890,907, which was filed on Aug. 23, 2019 and U.S. Provisional Application No. 62/892,872, which was filed on Aug. 28, 2019 the entire contents of which are hereby incorporated by reference.

TECHNICAL FIELD

The present invention relates to a diaphragm for use in an audio transducer and in particular, but not exclusively, to a diaphragm for use in a coaxial loudspeaker. The present invention further relates to an audio transducer and to a method of manufacturing a diaphragm for an audio transducer.

BACKGROUND

Audio transducers include a variant referred to as a coaxial driver, comprising a high frequency transducer sharing a common central axis with, and sitting within, a lower frequency transducer. One embodiment of a coaxial driver is a coaxial loudspeaker. The geometry of the diaphragm of the low frequency transducer is important for the performance of both the high frequency transducer and the low frequency transducer.

Typically, the critical features for diaphragm design in transducer performance are minimal mass combined with maximal stiffness. Thus, transducer diaphragms are historically thin-walled construction components, manufactured using processes which result in a largely homogeneous thickness, meaning that the geometry of one surface of the diaphragm dictates the geometry of the opposing surface of the diaphragm. This means that each surface of the diaphragm has a mutually-dependent geometry. Accordingly, optimising the geometry of the diaphragm for the performance of both high frequency and low frequency transducers has historically presented a challenge.

SUMMARY OF THE INVENTION

The present invention seeks to provide an improved diaphragm for use in an audio transducer such as a coaxial loudspeaker, with the aim of providing optimal performance of both high frequency and low frequency transducers.

According to a first aspect of the present invention, there is provided a diaphragm for use in an audio transducer which comprises a higher frequency transducer and a lower frequency transducer, the diaphragm being a component of the lower frequency transducer and being arranged coaxially with the higher frequency transducer, wherein the diaphragm comprises a first surface and an opposing second surface, the first surface of the diaphragm has a profile shaped to define a horn for output from the higher frequency transducer, and the geometry of the first surface is independent of the geometry of the second surface. The first surface and the second surface of the diaphragm are opposing since one faces in a first direction and the other faces in a second direction which is generally opposite to the first direction.

The output from the higher frequency transducer is the acoustic output, being sound waves with a higher frequency than the sound waves from the lower frequency transducer. The output from the higher frequency transducer may be high frequency sound waves.

The feature of the geometry of the first surface of the diaphragm being independent of the geometry of the second surface means that the profile of the first surface is shaped independently of the profile of the second surface. Hence the profile of the first surface is distinct from the profile of the second surface and the profile of the first surface is not dictated by the profile of the second surface and vice versa.

In one embodiment, there is provided a diaphragm for an audio transducer, the diaphragm comprising a forward-facing surface and a rearward-facing surface, wherein the geometry of the forward-facing surface is independent of the geometry of the rearward-facing surface, the forward-facing surface being profiled to form a horn with optimal geometry for a high frequency transducer and the rearward-facing surface being profiled to provide an optimal geometry for a low frequency transducer.

Forward-facing means facing in a first direction which is towards the front of the audio transducer. Rearward-facing means facing in a second direction which is towards the rear of the audio transducer.

The profiles of the first and second surfaces of the diaphragm are independently shaped. It is therefore possible for the diaphragm to have a first surface with a geometry which is optimised for performance of the lower and/or higher frequency transducers. Also, the first surface of the diaphragm has a geometry which is shaped as a horn for the higher frequency transducer. The second surface may have a geometry which is optimised for performance of the lower frequency transducer.

Accordingly, the present invention seeks to provide a diaphragm which is optimised for both higher frequency output and lower frequency output. The diaphragm of the present invention is particularly suitable for use in a coaxial loudspeaker.

The profile of the first surface may be generally convex in shape from an outer edge of the diaphragm to an inner edge of the diaphragm.

The profile of the first surface may have a generally curved geometry which defines a truncated acoustic volume which tapers towards the inner edge of the diaphragm, therefore defining a horn for the high-frequency transducer. The horn is shaped to have a narrow throat adjacent the inner edge of the diaphragm of the low frequency transducer and a wide mouth adjacent the outer edge of this diaphragm. The horn may be any shape for providing acceptable, preferably optimal, performance of the higher frequency transducer. The profile of the horn may be substantially exponential or substantially hyperbolic. The throat of the horn is adjacent to the high-frequency transducer which feeds acoustic energy to the throat of the horn.

Horns are well known to increase the radiation of sound. In the present invention they couple the relatively small voice coil area of a high frequency transducer to a relatively large area of air. The present invention allows the use of any horn design that gives the desired high frequency output while maintaining output from the low frequency transducer.

The profile of the second surface may be any shape for providing acceptable, preferably optimal, performance of the lower frequency transducer. In one example, the profile of the second surface is substantially linear in shape from an outer edge of the diaphragm to an inner edge of the diaphragm.

In one embodiment, the profile of the first surface is generally convex in shape and is non-symmetrical about an imaginary line drawn between the first surface and the second surface at the point of maximum distance between these two surfaces. This point of maximum distance is located closer to the inner edge of the diaphragm than the outer edge of the diaphragm. This forms a relatively narrow throat in the horn since the shape of the horn shape is defined by the profile of the first surface.

When the profile of the second surface is substantially linear in shape from an outer edge of the diaphragm to an inner edge of the diaphragm, the imaginary line drawn between the first surface and the second surface at the point of maximum distance between the first surface and the second surface is substantially perpendicular to the profile of the second surface.

When the diaphragm is circular in shape or is approximately circular in shape in plan view, the profile of each surface of the diaphragm is the shape in cross-section in a substantially radial direction of the diaphragm. The profile of each surface of the diaphragm is consistently shaped in all directions.

The diaphragm is generally conical in shape and may have the general shape of a truncated cone.

In an exemplary embodiment, both the first surface and the second surface of the diaphragm radiate lower frequency output.

In one embodiment, the second surface of the diaphragm is substantially enclosed by one or more components of the audio transducer, such as a frame and optionally a damper. When the second surface is substantially enclosed, the lower frequency output is primarily radiated from the first surface of the diaphragm.

The geometry of the second surface of the diaphragm provides a stiffness to the diaphragm without comprising the geometry of the first surface and the output of the audio transducer.

In view of the geometry of the first surface being independent of the geometry of the second surface, the diaphragm may have a non-uniform thickness from an outer edge of the diaphragm to an inner edge of the diaphragm.

Independently designing the geometry of the first surface and of the second surface necessitates an increase in diaphragm volume to accommodate the different surface geometries, so use of typical diaphragm materials results in an increase of the mass of the diaphragm, which may adversely affect the performance of the lower frequency transducer.

Accordingly, in an exemplary embodiment of the present invention, the diaphragm is formed of a material having a cellular structure. This provides a diaphragm having a low density and high stiffness, thereby compensating for the increased volume and enabling optimal performance of the lower frequency transducer.

For example, the diaphragm is formed of an expanded or foamed material, for example, an expanded or foamed plastic. In certain exemplary embodiments, the diaphragm is formed of an expanded polymer, for example expanded polypropylene. The diaphragm may alternatively be formed of other polymers including, but not limited to, polystyrene, polyurethane or acrylonitrile butadiene styrene (ABS). In alternative embodiments, the diaphragm may be formed of a cellular ceramic or stone material such as pumice, or a cellular structured metal (metal foam).

The diaphragm may be formed using any appropriate method for forming a structured cellular material. Where the diaphragm is formed of an expanded or foamed plastic, the diaphragm may be formed by molding. By way of example, the diaphragm is formed by structural foam molding, including injection molding and reaction injection molding (RIM).

According to a second aspect of the present invention, there is provided an audio transducer comprising a higher frequency transducer and a lower frequency transducer, wherein the lower frequency transducer comprises the diaphragm of the present invention, and wherein the diaphragm of the lower frequency transducer is arranged coaxially with the higher frequency transducer.

In one embodiment, a coaxial loudspeaker comprises a high frequency transducer coaxially mounted with a low frequency transducer, the low frequency transducer comprising a diaphragm according to the present invention.

The higher frequency transducer is accommodated within the lower frequency transducer. The higher frequency transducer may be accommodated within the structure of the lower frequency transducer.

The higher frequency transducer may be mounted independently of the diaphragm of the lower frequency transducer. The higher frequency transducer may be supported by the structure of the lower frequency transducer.

By mounting the higher frequency transducer independently of the diaphragm of the lower frequency transducer, the diaphragm is able to move independently of the higher frequency transducer.

The higher frequency transducer may be mounted within the boundary created by the inner edge of the diaphragm of the lower frequency transducer. The higher frequency transducer may be located centrally within the diaphragm of the lower frequency transducer in use of the audio transducer.

The audio transducer of the second aspect provides improved performance in both the higher frequency and the lower frequency ranges by virtue of the diaphragm and optimised for both the higher frequency transducer and the lower frequency transducer.

In an exemplary embodiment, the audio transducer comprises a flexible surround part and an outer edge of the diaphragm is connected to or is integral with the flexible surround part and the diaphragm is moveable independently of the higher frequency transducer.

The flexible surround part may extend between the outer edge of the diaphragm and a frame of the audio transducer to connect the diaphragm to the frame. The flexible surround part may be integral with or separate to the diaphragm. The flexible surround part may be integral with or separate to the frame.

According to a third aspect of the present invention, there is provided a method of manufacturing a diaphragm for an audio transducer which comprises a higher frequency transducer and a lower frequency transducer, the diaphragm being a component of the lower frequency transducer and being arranged coaxially with the higher frequency transducer, the method comprising forming a diaphragm comprising a first surface and an opposing second surface, wherein the first surface of the diaphragm is formed to have a profile shaped to define a horn for output from the higher frequency transducer, and the geometry of the first surface is independent of the geometry of the second surface.

The diaphragm may be formed by molding. In some embodiments, the method comprises placing an expandable material within a mold and subjecting the material to heat and/or pressure to cause the material to expand into a cellular structure. In alternative embodiments, the diaphragm may be formed by other molding techniques, such as injection molding or reaction injection molding (RIB).

According to the present invention, the higher frequency transducer may be a high frequency driver and the lower frequency transducer may be a mid or low frequency driver, with the high frequency driver and the low or mid frequency driver being coaxially arranged. The higher frequency transducer may be a tweeter. The lower frequency driver may be a woofer.

BRIEF DESCRIPTION OF THE DRAWINGS

Non-limiting embodiments of the invention will now be described, by way of example only, with reference to the accompanying drawings in which.

DETAILED DESCRIPTION OF EXEMPLARY EMBODIMENTS OF THE INVENTION

Figure 1:
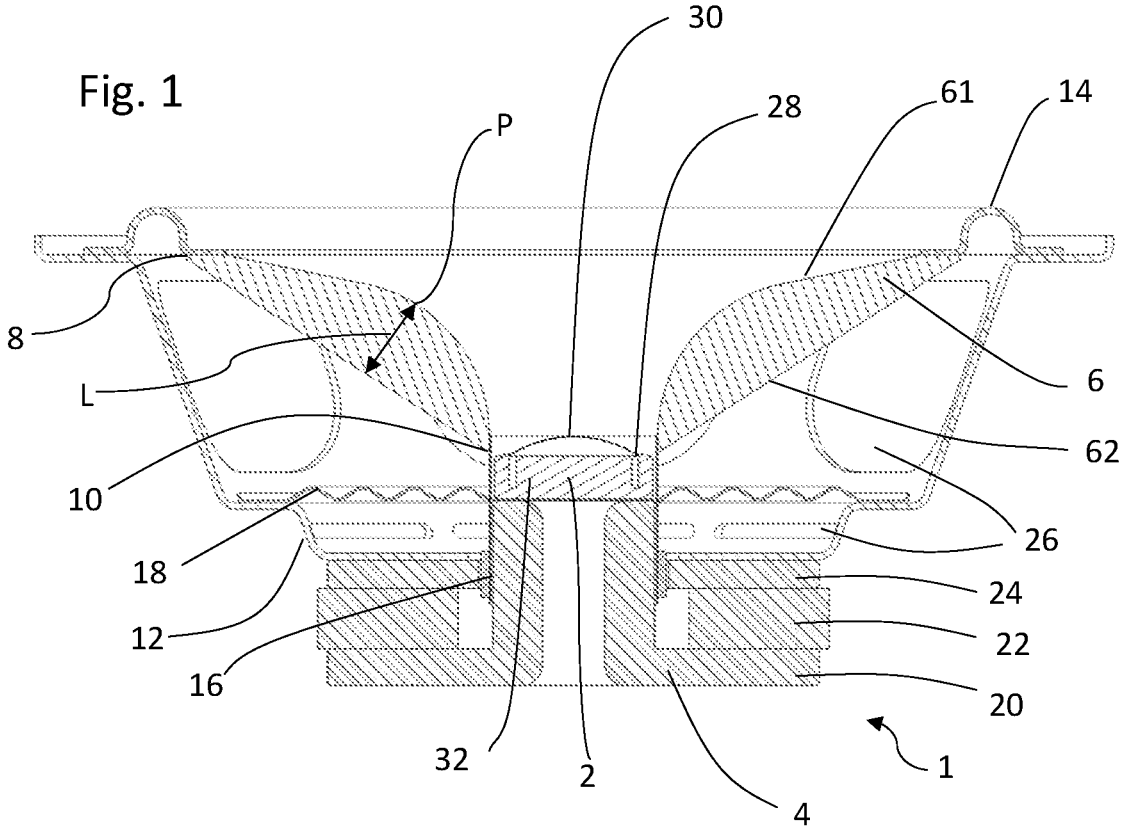
FIG. 1 is a cross-sectional diagram of a coaxial loudspeaker structure comprising a diaphragm in accordance with the present invention.

With reference to the Figures, there is shown a coaxial loudspeaker structure, indicated generally as 1, comprising a high frequency transducer 2 and a low frequency transducer 4. The low frequency transducer 4 comprises a diaphragm 6 having an outer edge 8 and an inner edge 10. In the illustrated embodiment, the diaphragm 6 has a truncated cone shape and therefore its outer edge 8 and its inner edge 10 are substantially circular. Other diaphragm shapes may be used without deviating from the scope of the present invention and these shapes may be symmetric or asymmetric.

The diaphragm 6 is connected at its outer edge 8 to a frame 12 by a surround 14 being a flexible surround part which is ring-shaped in the present embodiment. The diaphragm 6 is connected at its inner edge 10 to a voice coil 16. A damper 18 is provided between the voice coil 16 and the frame 12, such that one end of the damper is connected to the voice coil and the other end of the damper is connected to the frame 2. The coaxial loudspeaker structure 1 further comprises a T-yoke 20, a magnet 22 mounted on the T-yoke and a top plate 24. The voice coil 16 is positioned within a magnetic gap formed between the T-yoke 20 and the top plate 24. The frame is provided with apertures 26 in this embodiment.

The high frequency transducer 2 is mounted centrally within the inner edge 10 of the diaphragm 6 of the low frequency transducer, such that the high frequency transducer 2 and the low frequency transducer 4 share a common central axis being the central axis of motion of both the low frequency transducer and the high frequency transducer.

The high frequency transducer 2 is provided with its own arrangement of a voice coil 28, diaphragm 30 and magnet 32. The high frequency transducer 2 is mounted adjacent the T-yoke 20 of the low frequency transducer 4 and is accommodated within the structure of the low frequency transducer 4.

In operation, forward and rearward movement of the voice coil 16 along the central axis causes concurrent movement of the diaphragm 6. The high frequency transducer 2 is mounted independently of the diaphragm 6, permitting the diaphragm 6 to move independently of the high frequency transducer 2. The flexibility of the surround 14 permits movement of the diaphragm 6, allowing the diaphragm to move relative to the frame 12. The structure 1 may alternatively or additionally comprise a flexible element separate to the surround 14, the flexible element being arranged to permit movement of the diaphragm 6 independently of the high frequency transducer 2.

The diaphragm 6 has a first surface 61 defining a forward-facing geometry of the diaphragm 6 and a second surface 62 defining a rearward-facing geometry of the diaphragm 6. The geometry of these surfaces refers to the shape of their respective profiles. In the figures, the forward-facing direction is an upwards direction and the rearward-facing direction is a downwards direction.

As shown most clearly in FIG. 1, the forward-facing geometry of the diaphragm 6 is independent of the rearward-facing geometry. That is to say, the profile of the forward-facing surface 61 is independent of the profile of the rearward-facing surface 62. This is in contrast to diaphragms formed by traditional methods, where the thickness of the diaphragm is arranged to be substantially homogeneous, meaning that the respective profiles of the forward- and rearward-facing surfaces correspond in order to maintain a homogeneous thickness.

Figure 2:
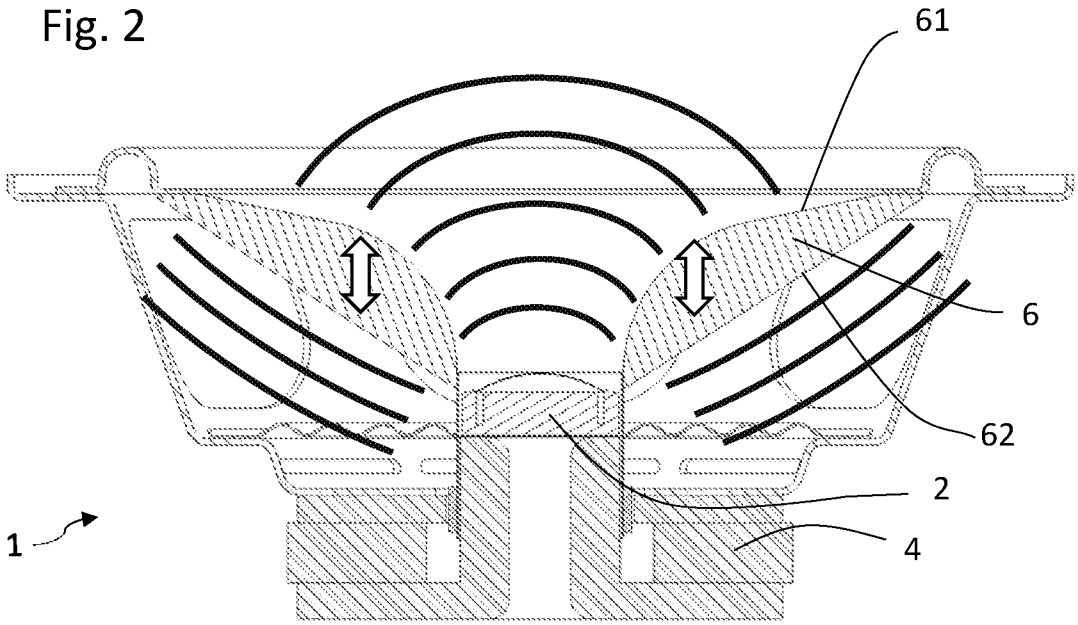
FIG. 2 is a cross-sectional diagram of the coaxial loudspeaker structure of FIG. 1 in use.
Figure 3:
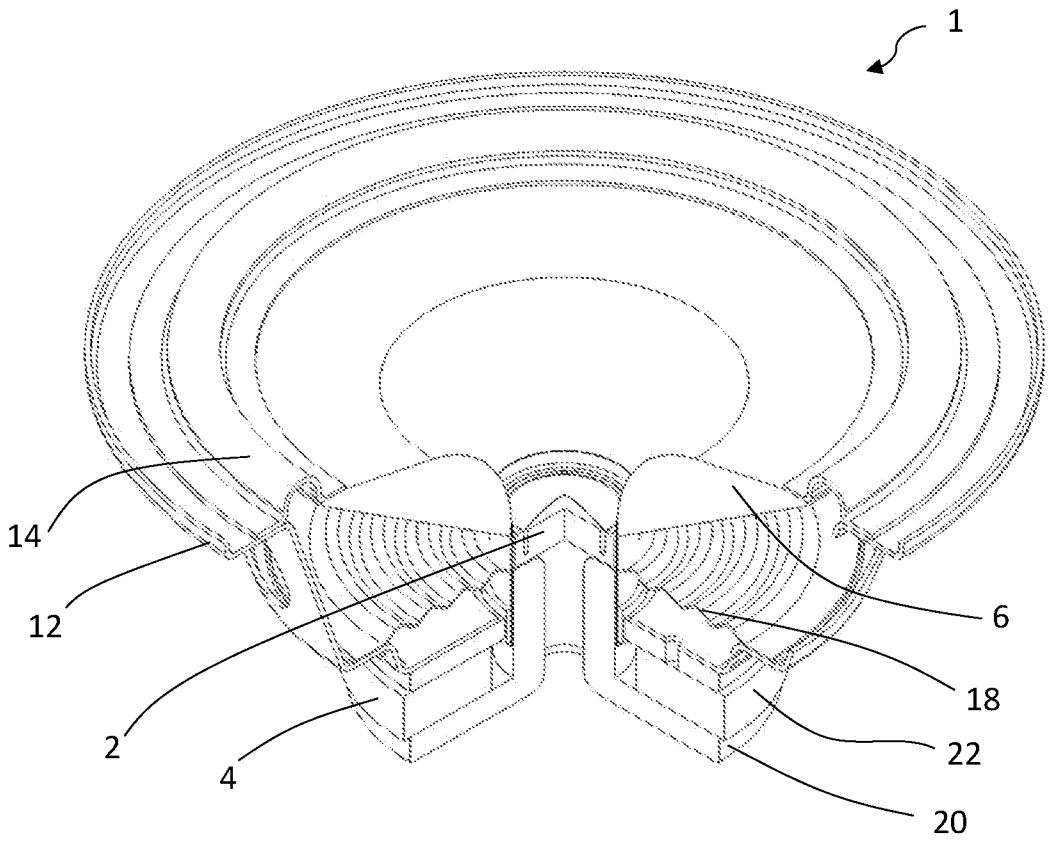
FIG. 3 is a perspective view of the coaxial loudspeaker structure of FIG. 1, wherein a section of the structure is cutaway.

Accordingly, with the present invention, the forward-facing surface 61 of diaphragm 6 is profiled to provide a forward-facing geometry which is optimised for the high frequency transducer 2. At the same time, the forward-facing surface 61 and the rearward-facing surface 62 are profiled to provide respective forward-facing and rearward-facing geometries which are each optimised for the low frequency transducer 4. Thus, the diaphragm 6 may be optimised for both the high frequency transducer 2 and the low frequency transducer 4. As shown in FIG. 2, the forward-facing surface 61 provides an optimally-shaped horn for high-frequency sound waves produced by the high frequency transducer 2. At the same time, the forward-facing surface 61 and the rearward-facing surface 62 provide an optimal geometry for low frequency sound waves produced by the low frequency transducer 4.

In the illustrated embodiment, the forward-facing surface 61 has a profile that is substantially convex in shape from the outer edge 8 to the inner edge 10 of the diaphragm 6. The rearward-facing surface 62 has a profile that is substantially linear in shape from the outer edge 8 to the inner edge 10 of the diaphragm 6.

With reference to FIG. 1, the profile of the first surface is non-symmetrical about an imaginary line L drawn between the first surface and the second surface at the point P of maximum distance between these two surfaces. This point of maximum distance is located closer to the inner edge 10 of the diaphragm than the outer edge 8 of the diaphragm. This forms a relatively narrow throat in the horn defined by the profile of the first surface.

Since the profile of the second surface 4 is substantially linear in shape from an outer edge 8 of the diaphragm to an inner edge 10 of the diaphragm, the imaginary line L drawn between the first surface and the second surface at the point P of maximum distance is substantially perpendicular to the profile of the second surface.

Since the diaphragm 6 of the embodiment is circular in shape in plan view, the profile of each surface of the diaphragm is the shape in cross-section in a substantially radial direction of the diaphragm. The profile of each surface of the diaphragm is consistently shaped in all radial directions.

The frequency ranges of the higher and lower frequency transducers used in the present invention depend on the exact transducers being used; for example, the frequencies will vary a lot depending on the size of the lower frequency transducer.

By way of example only, if the lower frequency transducer is a 15 inch (381 mm) woofer and the higher frequency transducer is a standard compression driver, the lower frequency range would be from about 20 Hz to 2000 Hz and the higher frequency range would be from about 2000 Hz to 20 Khz.

Owing to the differing profiles of the first surface 61 and the second surface 62, the thickness of the diaphragm 6 (that is, the dimension of the diaphragm 6 between the first surface 61 and second surface 62) is non-uniform from the outer edge 8 to the inner edge 10. It will be appreciated that the non-uniform thickness of the diaphragm 6 necessitates an increase in the volume of the diaphragm 6, compared to traditional diaphragms of homogenous thickness. In order to prevent reduced performance of the low frequency transducer 4 due to a resulting increased mass of the diaphragm 6, the diaphragm 6 is formed of a material having a cellular structure, for example expanded polypropylene. This provides the diaphragm 6 with sufficient stiffness and low density, thus permitting the forward-facing geometry and rearward-facing geometry of the diaphragm 6 to be independent, without a resulting loss in performance of the high frequency or low frequency transducers 2, 4. Alternative low density, high stiffness materials may be used to compensate for the increased volume of the diaphragm 6.

In embodiments of the present invention in which the diaphragm 6 of the low-frequency transducer is formed of an expanded or foamed plastic, the diaphragm 6 is formed using an appropriate molding technique. In such methods, an appropriate mold is provided, the mold having internal surfaces shaped to correspond to the forward-facing and rearward-facing geometries of the diaphragm. In an exemplary embodiment, beads or chips of an expandable or foamable material (such as polypropylene) are placed in the mold and subjected to pressure and/or heat to cause the material to expand into a cellular structure.

The invention has been described above with reference to a specific embodiment, given by way of example only. It will be appreciated that different configurations are possible, which fall within the scope of the appended claims.

The invention claimed is:

1. A diaphragm for use in an audio transducer which comprises a higher frequency transducer and a lower frequency transducer having a first voice coil, the diaphragm being a component of the lower frequency transducer and being arranged coaxially with the higher frequency transducer, the higher frequency transducer is mounted to the lower frequency transducer, and the higher frequency transducer includes a second voice coil, a secondary diaphragm and a magnet, the diaphragm comprising:

an outer edge and an inner edge, and the outer edge and the inner edge are substantially circular, a first surface defining a forward-facing surface, the forward-facing surface has a profile that all is a same convex curve in shape, and the forward-facing surface is from the outer edge to the inner edge of the diaphragm to define a horn for output from the higher frequency transducer, wherein the secondary diaphragm of the higher frequency transducer is located within the horn and the inner edge; and an opposing second surface defining a rearward-facing surface, the rearward-facing surface has a profile that all is linear in shape, and the rearward-facing surface is from the outer edge to the inner edge of the diaphragm, wherein a geometry of the first surface is independent of a geometry of the second surface and the profile of the cross-section shape of the diaphragm in all radial directions is consistent.

2. The diaphragm according to claim 1, wherein the diaphragm has a non-uniform thickness from an outer edge of the diaphragm to an inner edge of the diaphragm.

3. The diaphragm according to claim 1, wherein the diaphragm is formed of a material having a cellular structure.

4. The diaphragm according to claim 3, wherein the diaphragm is formed of an expanded or foamed material.

5. An audio transducer, comprising:

a lower frequency transducer having a first coil;

a higher frequency transducer including a second voice coil, a secondary diaphragm and a magnet, the higher frequency transducer being mounted to the lower frequency transducer; and a diaphragm, the diaphragm being a component of the lower frequency transducer and being arranged coaxially with the higher frequency transducer, the diaphragm comprising:

an outer edge and an inner edge, and the outer edge and the inner edge are substantially circular;

a first surface defining a forward-facing surface, the forward-facing surface has a profile that all is a same convex curve in shape, and the forward-facing surface is from the outer edge to the inner edge of the diaphragm to define a horn for output from the higher frequency transducer, wherein the secondary diaphragm of the higher frequency transducer is located within the horn and the inner edge; and an opposing second surface defining a rearward-facing surface, the rearward-facing surface has a profile that all is linear in shape, and the rearward-facing surface is from the outer edge to the inner edge of the diaphragm, wherein a geometry of the first surface is independent of a geometry of the second surface and the profile of the cross-section shape of the diaphragm in all radial directions is consistent.

6. The audio transducer according to claim 5, wherein the higher frequency transducer is accommodated within the lower frequency transducer.

7. The audio transducer according to claim 5, wherein the higher frequency transducer is mounted independently of the diaphragm of the lower frequency transducer.

8. The audio transducer according to claim 5, further comprising a flexible surround part, wherein an outer edge of the diaphragm is connected to or is integral with the flexible surround part and the diaphragm is moveable independently of the higher frequency transducer.

9. The audio transducer according to claim 8, further comprising a frame, wherein the flexible surround part extends between the outer edge of the diaphragm and the frame of the audio transducer to connect the diaphragm to the frame.

10. A method of manufacturing a diaphragm for an audio transducer which comprises a higher frequency transducer and a lower frequency transducer having a first voice coil, an outer edge and an inner edge, and the outer edge and the inner edge are substantially circular, the diaphragm being a component of the lower frequency transducer and being arranged coaxially with the higher frequency transducer, the higher frequency transducer is mounted to the lower frequency transducer, and the higher frequency transducer includes a second voice coil, secondary diaphragm and a magnet, the method comprising:

forming a diaphragm comprising a first surface and an opposing second surface, wherein the first surface of the diaphragm defining a forward-facing surface having a profile that all is same convex curve in shape, and the forward-facing surface is from the outer edge to the inner edge of the diaphragm to define a horn for output from the higher frequency transducer, and the opposing second surface defining a rearward-facing surface having a profile that all is linear in shape, and the rearward-facing surface is from the outer edge to the inner edge, and the secondary diaphragm of the higher frequency transducer is located within the horn and the inner edge, and wherein the geometry of the first surface is independent of the geometry of the second surface and the profile of the cross-section shape of the diaphragm in all radial directions is consistent.

11. The method according to claim 10, wherein the diaphragm is formed by molding.

12. The method according to claim 11, wherein the molding comprises:

placing an expandable material within a mold; and subjecting the material to heat and/or pressure to cause the material to expand into a cellular structure.

13. The method according to claim 12, wherein the material is a polymeric material.

14. The method according to claim 13, wherein the material is polypropylene.

* * * * *